US006676436B2

(12) United States Patent
Gaidosch

(10) Patent No.: US 6,676,436 B2
(45) Date of Patent: Jan. 13, 2004

(54) CABLE CONNECTOR

(75) Inventor: Othmar Gaidosch, Ostfildern (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 13 days.

(21) Appl. No.: 09/864,859

(22) Filed: May 25, 2001

(65) Prior Publication Data

US 2002/0019163 A1 Feb. 14, 2002

(30) Foreign Application Priority Data

May 26, 2000 (DE) ..... 100 26 294

(51) Int. Cl.[7] ..... H01R 11/20
(52) U.S. Cl. ..... 439/393; 439/427
(58) Field of Search ..... 439/393, 395, 439/427, 891, 441, 834, 835, 394; 174/88

(56) References Cited

U.S. PATENT DOCUMENTS 3,110,329 A * 11/1963 Lhomme et al. ..... 140/1
3,492,629 A * 1/1970 Hirsch ..... 439/394
3,786,173 A * 1/1974 Vogt ..... 174/88
3,861,772 A * 1/1975 Shaffer ..... 439/393
4,032,210 A * 6/1977 Vogt ..... 439/188
4,702,544 A * 10/1987 Vachhani et al. ..... 439/395
5,842,893 A * 12/1998 De Keyser ..... 439/783
6,244,893 B1 * 6/2001 Dudley et al. ..... 439/427
6,350,146 B1 * 2/2002 Su ..... 439/427

FOREIGN PATENT DOCUMENTS

EP 0684666 A2 * 5/1995

OTHER PUBLICATIONS

The History of the Yo–Yo, balerie Oliver, Copyright 2000, Spintastics Skill Toys, Inc., p. 3 of 4.*

* cited by examiner

*Primary Examiner*—Tho D. Ta
*Assistant Examiner*—James R. Harvey
(74) *Attorney, Agent, or Firm*—Fulbright & Jaworski, LLP

(57) ABSTRACT

A cable connector having a cable receiving part for holding at least one cable end and a contact part configured to secure the cable end in the cable receiving part such that it is mechanically pretensioned after connection. A clamping device may be associated with the receiving part, which may also include a tapered line chamber. The contact part may include an insulation piercing connecting device for securing the cable end, wherein the axial center line of the device may be parallel or not parallel with the axial center line of the line chamber.

14 Claims, 2 Drawing Sheets

CABLE CONNECTOR

BACKGROUND OF THE INVENTION

1. Field of the Invention

The present invention relates to a cable connector. More particularly, the present invention relates to a multipin cable connector.

2. Description of the Related Technology

EP 0 684 666 B1 discloses a multipin cable connector. This cable connector has a cable receiving part into which individual flexible leads are inserted for making axial contact of their plug-side end sections with the cable-side end areas which are configured as contact spikes. Upon insertion, the contact spikes penetrate axially into the individual leads such that contact is made.

In studying a cable connector over an extended period, it has been found that the force in the contact area of the contact spike decreases with time so that after prolonged use of the cable connector; reliable contact-making is no longer ensured. Data transmission or power supply via such a cable connector is not always guaranteed. As will be appreciated by one of ordinary skill in the art, when data transmission or power supply fails, undesirable effects, especially in situations critical to safety, can occur.

SUMMARY OF THE INVENTION

Therefore one object of the invention is to devise a cable connector of the aforementioned type for connection of single-core or multicore stranded cable of any configuration, in which permanently reliable contact-making is ensured.

This and other objects may be achieved by providing a cable connector having a cable receiving part for holding a cable end, wherein said cable end is mechanically pretensioned in said cable receiving part after connection by a contact-making means.

According to one aspect of the invention, the contact-making means comprises an insulation piercing connecting device which secures the cable end in the cable receiving part such that after connection it is mechanically pretensioned. Using an insulation piercing connecting device ensures that the cable end can be inserted into the cable receiving part quickly and easily, i.e. without major prior effort, which prevents stripping the insulation.

The insulation piercing connecting device during installation ensures that the outer insulation of the cable end may be split and electrical contact with the core of the cable is established. Because the insulation piercing connecting device fixes the cable end in the cable receiving part such that after electrical connection it is under stable mechanical pretension, permanently reliable contact-making is ensured since as a result of this pretensioning the cable end is always pressed in the direction of the insulation piercing connecting device or vice versa. As will be appreciated by one of ordinary skill in the art, this is of great importance when the core of the cable consists of copper leads since copper has the property of creeping.

The cable connector is preferably used for single-core cable, but of course may also be used for several individual cables and also for a single multipin cable. The structural shape of the cable connector (round, square or the like) is irrelevant.

According to one aspect of the invention, the cable receiving part has a line chamber which is larger in cross section than the cross section of the cable. The cable end is thus guided along the line chamber when inserted into the cable receiving part. At the same time, the cable end after fixing in the cable receiving part can move slightly when contact is made with the insulation piercing connecting device, resulting in mechanical pretensioning. In the penetration or contact-making area, especially in the X-Y plane, it is not necessary to route the cable end along a defined path. As will be appreciated by one of ordinary skill in the art, this provides for a simple configuration of the cable receiving part and its assembly. As will also be appreciated, another advantage lies in the use of cable ends with differing thicknesses.

According to another aspect of the invention, the cable receiving part has a clamping sleeve. This clamping sleeve can be inserted either after insertion of the cable end into the cable receiving part or inserted when the cable end is being inserted into the line chamber and can be penetrated by the cable end. After the cable end has been inserted into the line chamber, the clamping sleeve is attached (preferably mechanically) and fixes the position of the cable end with reference to the cable receiving part. Alternatively, before the cable end has been inserted, the clamping wedges can be made as barbs, which after insertion of the cable end, hold the latter. In this installation step, provisions can be made for the piece of the cable end which is located in the line chamber to be under mechanical pretension. This increases the effectiveness of contact-making since this mechanical pretensioning arises when contact is made with the insulation piercing connecting device. In addition, fixing the cable end by means of the clamping sleeve results in the cable end being unable to move out of the line chamber when contact is made with the insulation piercing connecting device. Instead of a clamping sleeve it is of course also conceivable for the cable to be fixed detachably or permanently in the line chamber, with the last piece of the cable remaining freely movable in the line chamber. With respect to permanent fixing, it is also possible to cement the cable in the top end of the line chamber. The use of a clamping sleeve, however, has the advantage that it can be both inserted mechanically and also fixed.

According to another aspect of the invention, the insulation piercing connecting device is located in a receiving means for insulation piercing connecting devices. The receiving means for the insulation piercing connecting devices can be connected to the cable receiving part. Thus, as described above, the cable end can be inserted into the cable receiving part and fixed. The insulation piercing connecting device may then penetrate into the lower area of the line chamber by feed of the receiving means for the insulation piercing connecting devices and cause contact to be made. Finally, the cable receiving part and the receiving means for the insulation piercing connecting devices may be connected to one another (for example, by clipping, screwing, welding, cementing or the like) to form a finished cable connector. The insulation piercing connecting device on its side facing away from the contact area has connection means, such as contact pins, contact tubes or the like. They can be exposed or can also be concentrically surrounded by part of the receiving means for the insulation piercing connecting devices.

According to another aspect of the invention, the line chamber tapers in its end area (contact area). This tapering results in a transverse arrangement of the cable end buckling direction, by which further alignment of the cable end to the spring direction of the insulation piercing connecting device is no longer necessary. Furthermore, due to this tapering (wedge-shaped configuration) of the line chamber it can be provided with cable ends (wires) of different diameters. For different diameters the tapering causes the cable end to be guided in the direction in which the cable end assumes a position in which it can be reliably penetrated by the insulation piercing connecting device.

According to another aspect of the invention, the line chamber has a diamond-shaped cross section. This configuration of the cross section of the line section ensures that the cable end has enough room for slightly curved deformation, and that centering takes place which ensures that upon making contact with the insulation piercing connecting device the cable end cannot recede such that contact is not made.

According to yet another aspect of the invention, the center lines of the insulation piercing connecting device and the line chamber are flush, parallel or tilted to one another. The almost axial or ideally axial penetration of the insulation of the cable end yields a large-area, highly redundant, permanently elastic and gas-tight electrical connection between the insulation piercing connecting device and the conductive core of the cable end.

BRIEF DESCRIPTION OF THE DRAWINGS

One embodiment of the cable connector according to the invention, to which however the invention is not limited, is described below and explained using the figures, wherein.

DETAILED DESCRIPTION

Figure 1:
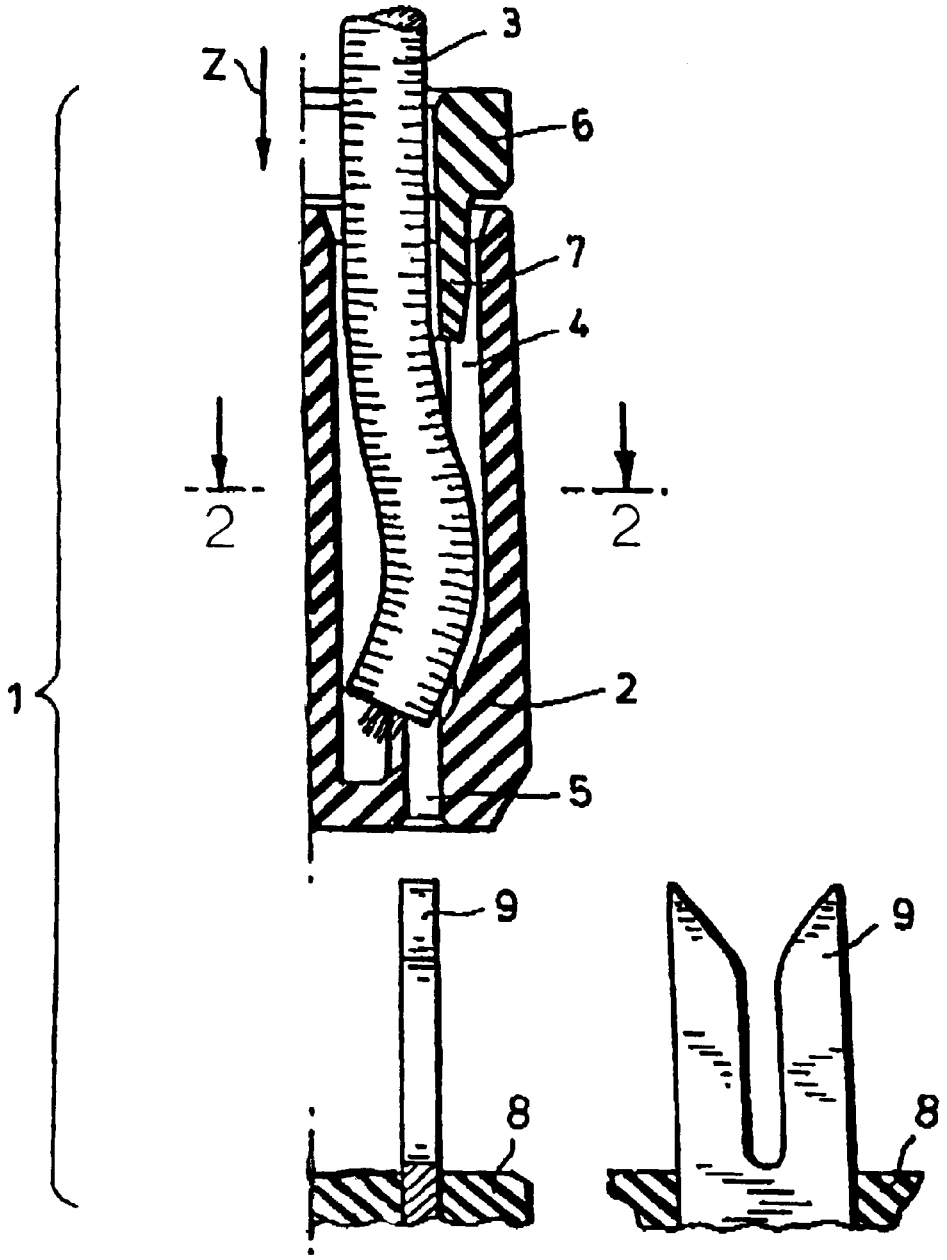
FIG. 1 shows a cable connector in a lengthwise section.

FIG. 1 shows a cable connector 1 with a cable receiving part 2 into which one cable end 3 can be inserted. For this purpose, in the cable receiving part 2 there is a line chamber 4 with a cross section (especially a diameter) which is slightly larger than the diameter of the cable end 3. In the lower area of the cable receiving part 2 there is an opening 5 (slit) through which an insulation piercing connecting device yet to be described can be inserted into the line chamber 4. In the top area of the cable receiving part 2 there is a clamping sleeve 6 which has a clamping wedge 7 which extends in the axial direction (Z direction). The clamping wedge has an extension such that it at least partially fills the remaining space of the cross section of the line chamber 4 which is not filled by the cable end 3 and in addition can exert sufficient pressure on the cable end 3.

The cable connector 1 shown in FIG. 1 is assembled as follows.

The cable end 3 is threaded through the clamping sleeve 6 in the Z-direction and is inserted into the line chamber 4 of the cable receiving part 2. The clamping sleeve 6 is then likewise brought together with the top collar of the cable receiving part 2 and locked such that the clamping wedge 7 prevents the cable end 3 from receding. The wedge-shaped tapering of the line chamber 4 in the Z direction causes the tip of the cable end 3 with respect to the insulation piercing connecting device to assume a defined position or the accordingly cropped cable end 3 to buckle slightly at least once in the X direction, i.e. the cable end 3 to assume a slightly curved or also S shape. An insulation piercing connecting device 9 which is located in a receiving means 8 for insulation piercing connecting devices is inserted through the slotted opening 5 into the line chamber 4 which is equipped with the cable end 3. The axial force applied via the insulation piercing connecting device 9 first drives back the free cable end 3 and initiates or intensifies its buckling until the buckled areas of the cable end 3 completely adjoin the walls of the line chamber 4. In this state then the neutral fiber of the core of the cable end 3 is deformed such that it intersects the center line of the insulation piercing connecting device at least once in a curved shape. As soon as the free ends of the wires cannot further recede as a result of the clamping force of the clamping sleeve 6 and additionally as a result of the friction of the insulation of the cable end 3 on the walls of the line chamber, the insulation is penetrated and electrical contact is made with the insulation piercing connecting device 9. Then provisions must be made for the cable receiving part 2 to be connected to the receiving means 8 of the insulation piercing connecting devices stably and detachably or undetachably to one another. The receiving means 8 for the insulation piercing connecting devices can be for example part of the cable connector; but it is also conceivable for the insulation piercing connecting device 9 to be located on an electronic circuit board or to project out of a module, and then the receiving means 8 for the insulation piercing connecting devices would be the board or the housing of the module. The axial center line of the line chamber 4 can also be tilted obliquely to the Z-axis or Y-axis.

Figure 2:
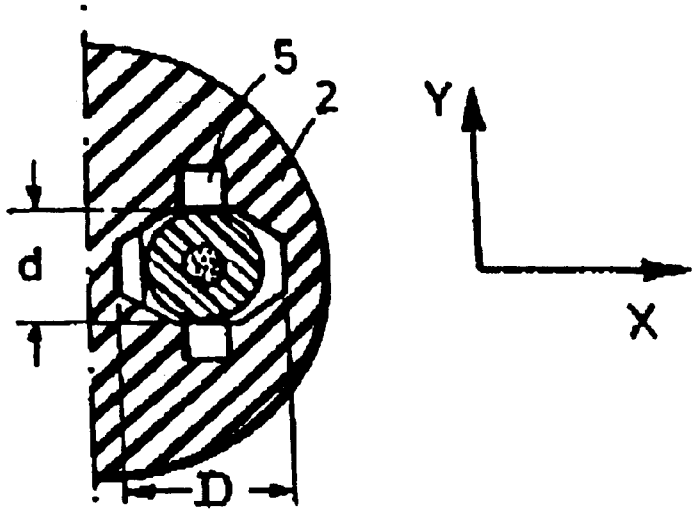
FIG. 2 shows a cable connector in cross section.

FIG. 2 shows the cable connector 1 in cross section A—A as shown in FIG. 1. In this Figure the diamond-shaped cross section of the line chamber 4 can be seen, the dimensions d and D, i.e. the extension of the diamond-shaped line chamber 4 in the X and Y direction, being different from one another. In any case it can be ensured that one of the two parameters d or D or both parameters are slightly larger than the diameter of the cable end 3 so that it can deform in the line chamber 4 in a curve shape during insertion. One especially advantageous case is when the line chamber 4 has a diamond shape and the equation d equals D is satisfied. In this way especially space-saving implementations are possible. Of course, it is also possible for the line chamber 4 to have a round, oval, square, rectangular cross section or one which represents a combination of these geometrical cross sections.

What is claimed:

1. A cable connector comprising:

a cable receiving part having a line chamber disposed inside said receiving part, said line chamber having a linear longitudinal length with an inside cross section area along a portion of the linear longitudinal length that is larger than a cross section of a cable disposed inside said line chamber;

said cable receiving part further having an opening slot disposed through said cable receiving part and into said line chamber, said opening slot having an inside cross section area that is smaller than the cross section of said cable so that said cable can not pass through said opening slot and out of said line chamber; and a receiving means having a connecting device disposed to fit through said opening slot and adapted to electrically connect to a distal end of said cable and disposed in said line chamber; wherein, when said connecting device is connected to the distal end of said cable, the distal end of said cable is bent inside a portion of the linear longitudinal length of said line chamber having an inside cross section area larger than the cross section of said cable and the distal end of said cable is compressed within said line chamber.

2. The cable connector of claim 1, wherein said connecting device of said receiving means receiving means comprises an insulation piercing connecting device.

3. The cable connector of claim 1, wherein an inside cross section area of said line chamber is smaller than the cross section of said cable at an end area of said line chamber that is disposed adjacent said opening slot.

4. The cable connector of claim 3, wherein the inside cross section area of said line chamber that is adjacent said opening slot tapers in a wedge-shape or arc-shape.

5. The cable connector of claim 1, wherein the inside cross section area of said line chamber has a diamond-shaped cross section.

6. The cable connection of claim 2, wherein an axial center line of said insulation piercing connecting device and an axial center line of said line chamber are parallel with one another.

7. The cable connection of claim 1, wherein said cable is compress within said line chamber with at least one bend in said cable.

8. A cable connector comprising:

a cable receiving part including a line chamber means for holding a cable, said line chamber means being disposed inside said cable receiving part, said line chamber means having a linear longitudinal length with an inside cross section area along a portion of the linear longitudinal length that is larger than a cross section of said cable disposed inside said line chamber means, said cable receiving part further having an opening slot disposed through said cable receiving part and into said line chamber means, said opening slot having an inside cross section area that is smaller than the cross section of said cable so that said cable can not pass through said opening slot and out of said line chamber; and a receiving means having a connecting device means for electrically connecting to a distal end of said cable disposed in said line chamber means, said connecting device means disposed to fit through said opening slot;

wherein, when said connecting device means is connected to the distal end of said cable, distal end of said cable is bent inside a portion of the linear longitudinal length of said line chamber means having an inside cross section area larger than the cross section of said cable and the distal end of said cable is compressed within said line chamber means.

9. The cable connector of claim 8, wherein said connecting device means comprises an insulation piercing connecting device means for electrically connecting to a distal end of said cable.

10. The cable connector of claim 8, wherein an inside cross section area of said line chamber means is smaller than the cross section of said cable at an end area of said line chamber means that is disposed adjacent said opening slot.

11. The cable connector of claim 10, wherein the inside cross section area of said line chamber means tapers in a wedge-shape or arc-shape.

12. The cable connector of claim 8, wherein an axial center line of said connecting device means is parallel with an axial center line of said line chamber means.

13. The cable connector of claim 8, wherein the inside cross section area of said line chamber means has a diamond-shaped configuration.

14. The cable connector claim 8, further comprising clamping means for securing said cable in said line chamber means.

* * * * *